US006301733B1

(12) United States Patent
Dawson et al.

(10) Patent No.: US 6,301,733 B1
(45) Date of Patent: Oct. 16, 2001

(54) PROCESS AND DISPENSING DEVICE FOR WASHING LAUNDRY IN A WASHING MACHINE

(75) Inventors: George Thomas Dawson, Wirral (GB); Francois Delwel, Vlaardingen (NL); James William Gordon, Vlaardingen (NL); Albert Cornelis de Jong, Vlaardingen (NL); Colin Watt Kerr, Wirral (GB); Edwin Leo Lempers, Vlaardingen (NL); Loic Marie Tardy, Ho Chi Minh (VN)

(73) Assignee: Lever Brothers, division of Conopco, Inc., New York, NY (US)

( * ) Notice: Subject to any disclaimer, the term of this patent is extended or adjusted under 35 U.S.C. 154(b) by 0 days.

(21) Appl. No.: 09/035,163

(22) Filed: Mar. 5, 1998

(30) Foreign Application Priority Data

Mar. 7, 1997 (GB) ..... 9704782

(51) Int. Cl.[7] ..... D06F 39/02

(52) U.S. Cl. ..... 8/158; 68/17 R; 206/0.5; 134/93

(58) Field of Search ..... 134/93; 68/207, 68/17 R, 17 A; 206/0.5; 8/158

(56) References Cited

U.S. PATENT DOCUMENTS

| | | | | |
|---|---|---|---|---|
| 2,470,851 | | 5/1949 | Hermanson | 252/93 |
| 2,826,484 | * | 3/1958 | Buehler . | |
| 4,047,550 | | 9/1977 | Scholz | 150/52 |
| 4,228,834 | | 10/1980 | Desnick | 150/3 |
| 4,260,054 | | 4/1981 | Bory et al. | 206/0.5 |
| 4,532,722 | * | 8/1985 | Sax . | |
| 4,969,927 | | 11/1990 | Schumann et al. | 8/159 |
| 5,033,643 | * | 7/1991 | Schumacher . | |
| 5,129,120 | * | 7/1992 | Cornette et al. . | |
| 5,388,398 | * | 2/1995 | Rutter et al. | 68/17 R |
| 5,425,253 | * | 6/1995 | Rizzo | 68/17 R |
| 5,768,917 | * | 6/1998 | Freida et al. | 68/17 R |

FOREIGN PATENT DOCUMENTS

| | | | | |
|---|---|---|---|---|
| 290 332 | | 5/1988 | (EP) . | |
| 331 542 | | 2/1989 | (EP) . | |
| 0473532 | | 3/1992 | (EP) . | |
| 0576234 | | 12/1993 | (EP) . | |
| 576 234 | | 12/1993 | (EP) . | |
| 0610535 | | 8/1994 | (EP) . | |
| 0628652 | | 12/1994 | (EP) . | |
| 0479711 | | 12/1995 | (EP) . | |
| 0691102 | | 1/1996 | (EP) . | |
| 780 508 | | 12/1996 | (EP) . | |
| 823 236 | | 2/1998 | (EP) . | |
| 846 798 | | 6/1998 | (EP) . | |
| 2244722 | * | 12/1991 | (GB) | 68/17 A |
| 99/55822 | | 11/1999 | (WO) . | |

OTHER PUBLICATIONS 253,419 Eurpoean Patent Office 68/17R, Jan. 1987.*

* cited by examiner

*Primary Examiner*—Frankie L. Stinson
(74) *Attorney, Agent, or Firm*—Rimma Mitelman

(57) ABSTRACT

A process for washing laundry in a washing machine employs a receptacle for dispensing a detergent tablet. The receptacle is substantially rigid and includes a number of apertures which have an average dimension equivalent to a mesh size of between 1 and 10 mm. A solid detergent in the form of a tablet is placed in the dispensing receptacle, the latter then being placed into a washing machine along with laundry to be washed and a washing operation is carried out. After the washing operation, the device is removed from the machine and stored for subsequent use.

Moreover, the invention relates to a dispensing device for carrying out this process.

18 Claims, 3 Drawing Sheets

PROCESS AND DISPENSING DEVICE FOR WASHING LAUNDRY IN A WASHING MACHINE

INTRODUCTION

The invention relates to a process for washing laundry in a washing machine by employing a receptacle for dispensing at least one detergent tablet, the receptacle being substantially rigid and having a plurality of apertures for permitting the passage of an aqueous solution there through, the process comprising the steps of placing the dispensing receptacle having at least one detergent tablet contained therein in a washing machine together with the laundry to be washed, and carrying out a washing operation. The invention also relates to a dispensing device for carrying out the above process.

Dispensing devices for detergent tablet compositions are known. For example DK-B-165 759 discloses a dispensing device having a flexible fluid permeable sleeve arranged in an enclosing manner about a rigid hollow body forming an annular chamber between the sleeve and the body, the body having an inlet opening for insertion of the tablet. EP-A1-0628 652 describes a similar dispensing device. Both of these devices include relatively complicated means for delivering a tablet from the opening in the hollow body to the annular chamber, are expensive to make and complicated in use.

EP-A1-0-473-532 discloses a further dispensing device for use with detergent tablets which comprises a water permeable fabric bag having a slotted opening and a freely movable body within the bag to effect the disintegration of the tablet. If, however, the fabric bag described above was analysed after a washing operation, a large number of detergent residues would be embedded in the material of the bag. This results in detergent being wasted and the bag having decreased water permeability.

EP O 699 410 discloses a dispenser for, primarily machine dishwash, detergent tablets which comprises an open topped rigid cage having pincers for picking up tablets. A problem with this device is that the apertures in the cage appear quite large and thus would allow large undissolved tablet particle escape into the wash to cause dye damage to the clothes. A further problems is the rather complicated structure.

EP 0 479 711 describes a further device comprising a two-part rigid sleeve having an outer sleeve of flexible water permeable material. In use a tablet is inserted between the rigid and flexible sleeves before the device is placed in a washing machine. Again this device is of quite complicated construction. Further it requires considerable dexterity for successful positioning of the tablet between the two sleeves.

EP 0 691 102 describes a cage dispenser for tablets having a child resistant closure. The apertures in the cage are quite large and would allow sizeable detergent particle escape into the wash.

EP O 610 535 discloses a fabric bag dispenser for powdered detergents, the bag having holes of a size sufficient to allow water penetrate but preventing the powder escape. The use of such a bag with detergent tablets would likely lead to poor break-up and dissolution of the tablet and result in a high level of residues left in the bag.

EP O 576 234 describes a tablet dispenser comprising an elastic net sleeve which, upon insertion of the tablets, conforms tightly to the tablets. A number of problems are associated with this dispenser. First, as the tablets are held by the sleeve in a face to face configuration, less of the tablets surface area is exposed to the wash water. This leads to a decreased rate of dissolution of the tablets which results in a greater level of detergent residues left in the machine after the wash. A consequence of this is an increased incidence of dye fading due to detergent residues or particles coming into direct contact with clothes. Second, as the net conforms tightly to the tablets, the tablets are firmly pushed against the net resulting in parts of the tablet being exposed through the net to the clothes in the wash. Such exposure will lead to increased levels dye damage. Furthermore, as the elastic net prevents the tablets moving around the net, mechanical disintegration of the tablets is reduced. Finally, as the net is elastic, the mouth of the sleeve tends to be quite small which makes insertion of the tablets difficult.

It is an object of the present invention to provide a dispensing device and washing process which overcomes at least some of the above problems.

STATEMENTS OF INVENTION

According to the invention, there is provided a laundry washing process of the above type, the process being characterised in that the apertures of the dispensing receptacle have an average dimension equivalent to a mesh size of between 1 mm and 10 mm.

Surprisingly, it has been found that as the equivalent mesh size of the apertures increases above 1 mm, that the incidence of dye damage, ie. the effect of direct contact between the tablet and the clothes, decreases. It would have been expected that as the size of the holes increased, the greater the dye damage would be due to the greater exposure of the tablet through the holes in the net. In practice, the opposite effect has been observed when the process of the invention is carried out.

A further surprising effect of the process of the present invention is that the incidence of detergent tablet residues remaining in the machine after a washing operation decreases. This is quite unexpected in so far as it would be assumed that, as the mesh size increases, the greater the number of undissolved residues would escape from the device into the wash. However, again, the opposite effect has been observed with the process of the invention.

The equivalent mesh size of the apertures of the device the present invention is limited to less than 10 mm. Mesh sizes above this figure result in large particles escaping into the wash. This is undesirable due to the increased incidence of dye damage which results.

In one embodiment of the process, the apertures have an average dimension equivalent to a mesh size at least 2 mm, ideally at least 3 mm, more preferably at least 4 mm and most preferably approximately 5 mm. Typically, the equivalent mesh size of the apertures net is at most 9 mm, ideally at most 8 mm, preferably at most 7 mm, and most preferably at most 6 mm.

Preferably the apertures of the device have an average dimension equivalent to a mesh size of approximately 5 mm.

In one embodiment of the invention, the detergent tablet comprises a tripolyphosphate composition, typically comprising a compacted particulate detergent composition containing one or more detergent-active compounds together with sodium tripolyphosphate and other ingredients, and in which the tablet or a region thereof comprises particles which contain sodium tripolyphosphate with a content of the phase 1 form which is more than 40% by weight of the sodium tripolyphosphate in said particles, wherein the sodium tripolyphosphate in said particles contains water of hydration distributed throughout the tripolyphosphate in an amount between 1% and 5% by weight of the sodium tripolyphosphate in the particles.

Alternatively, the detergent tablet may comprise sodium acetate trihydrate, optionally together with sodium citrate dihydrate. Such a composition may for example comprise a compacted particulate composition in which the tablet comprises a compacted particulate composition in which the tablet comprises a compacted particulate detergent composition comprising 2% to 35% by weight of a salt which is sodium acetate trihydrate, potassium acetate or mixture thereof, optionally together with sodium citrate dihydrate, such that the total quantity of sodium acetate trihydrate, potassium acetate and sodium citrate dihydrate is from 7% to 50% by weight of the tablet or a region thereof. Optionally, the tablet or a region thereof comprises from 15% to 93% by weight of a water softening agent.

The process according to the invention will preferably include a reusable receptacle which comprises an opening for reception of the detergent tablet and closure means for preventing the passage of the tablet out of the receptacle through the opening, the process thus including an initial step of placing one or more of detergent tablets in the receptacle.

In one embodiment of the invention the device will comprise a rigid, preferably oval, receptacle having a plurality of apertures formed therein and an opening at one or each end for reception of a detergent tablet. Therefore each opening will have an associated closure which preferably will comprise a plurality of resiliently flexible fingers mounted to and extending radially from an end portion of the receptacle adjacent the opening.

Alternatively, the receptacle may comprise two parts which when connected together form a housing for a detergent tablet. Ideally, the parts are connected by a hinge means.

In one embodiment of the invention, the two parts of the receptacle are injection moulded in one piece.

The receptacles described above in connection with the process of the invention are produced from a material capable of withstanding temperatures for the machine washing or drying of laundry, especially up to 150° C.

The invention also provides a dispensing device for carrying out the process according to the invention, which device broadly comprises a substantially rigid receptacle having a plurality of apertures for permitting the passage of an aqueous solution there through, the apertures being dimensioned so as to prevent the passage of the detergent tablet or a significant portion thereof through the apertures, while ideally permitting the passage of particulate disintegration products of the tablet, the apertures preferably having an average dimension equivalent to a mesh size of between 1 mm and 10 mm.

The invention also provides a dispensing device according to the invention in combination with one or more detergent tablets.

DETAILED DESCRIPTION OF THE INVENTION

The invention will be more clearly understood from the following description of some embodiments thereof, given by way of example only, with reference to the accompanying drawings in which.

Figure 1:
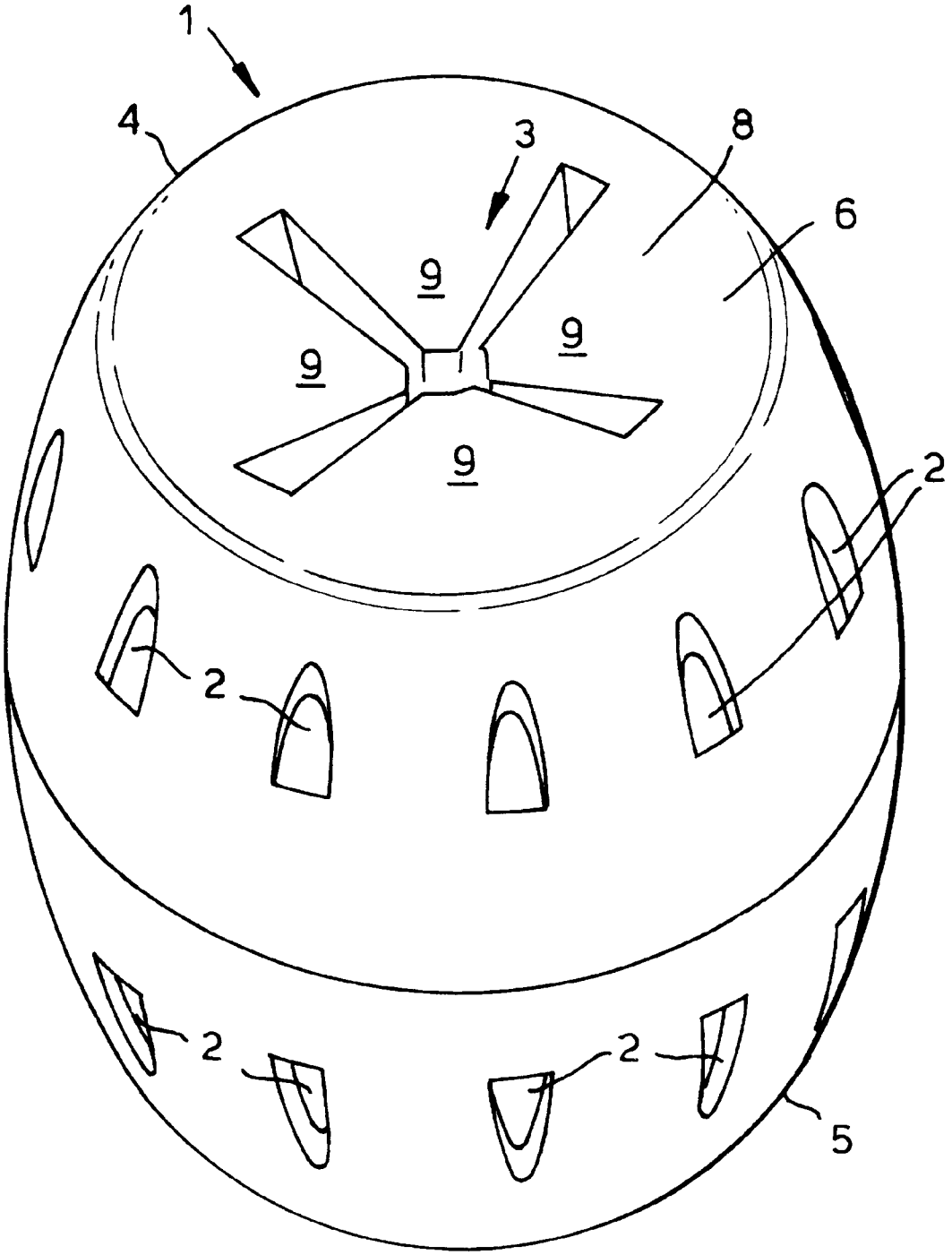
FIG. 1 is a perspective view of a device according to the invention.

Referring to 1, there is illustrated a dispensing device according to the invention indicated generally by the reference numeral 1, comprising a rigid, oval receptacle having a plurality of circumferentially arranged apertures 2, each having an average diameter of approximately 5 mm, and a opening 3 at each end 4,5 thereof. A closures 8 is provided at each opening 3, each closure in this case comprising four resiliently flexible fingers 9 mounted to and extending radially from a periphery 6 of each opening and extending partially across the opening.

In use, one or more detergent tablets are placed in the device 1 by pushing each tablet against the closure 8 until the resiliently flexible fingers 9 bend sufficiently to allow a tablet past the closure and into the device 1. Once the tablet has passed into the device 1, the fingers spring back to their normal position partially covering the opening 3. Generally, two tablets will be used for one washing operation. The device 1 with the tablets contained therein is then placed in a washing machine with the clothes to be washed and a washing operation is carried out during which the detergent tablet(s) within the bag will disintegrate and dissolve. When the washing operation has been completed, the device 1 is removed from the machine and stored for subsequent use.

Figure 2:
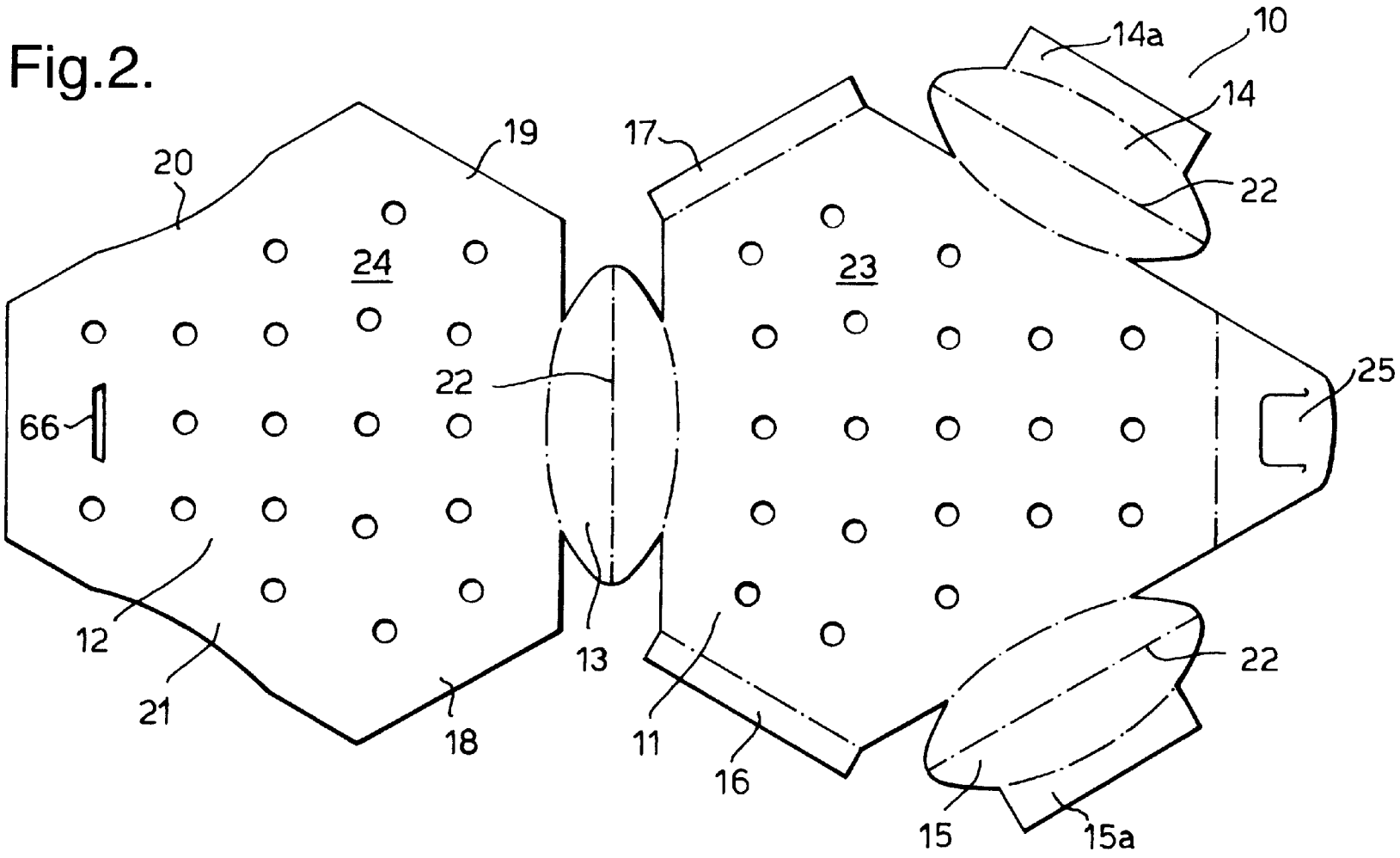
FIG. 2 is a plan view of a blank for assembling a device according to a further embodiment of the invention.

FIG. 2 illustrates another embodiment of the device 10 in two, nearly symmetrically, opposed parts 11, 12, each part 11,12 having a plurality of 5 mm holes, which parts are hingedly connected by a spacing joint 13. A pair of further spacer joints 14, 15 are provided on the part 11, each joint having an exposed joining tab 14*a*, 15*a*. Further joining tabs 16, 17 are provided in the first part. On assembly, the device 10 is folded so that the parts 11, 12 abut and the joining tabs 16, 17 on the first 11 are sealed to corresponding points 18, 19 on a rear face of the second part 12. The exposed tabs 14*a*, 15*a* are sealed to corresponding points 20, 21 on a rear of the second part 12. Each of the spacer joints 13, 14 and 15 are weakened along a longitudinal axis indicated by dotted lines 22 so that the spacer joints 13, 14 and 15 can fold to allow the two parts 11, 12 abut or snap into an extended arrangement in which faces 23, 24 of the two parts 11, 12 are spaced apart. An opening is provided on the assembled device (not shown) opposite the spacer joint 13. A tab 25 on the first part 11 engages a slot 26 on the second part 12 to close the opening. In use, the device 10 will generally be provided in an assembled but flat arrangement whereupon straightening of the spacer joints spaces the two parts apart. A detergent tablet is then inserted into the device through the opening which is then closed. The subsequent use is similar to that of previously described embodiments.

Figure 3:
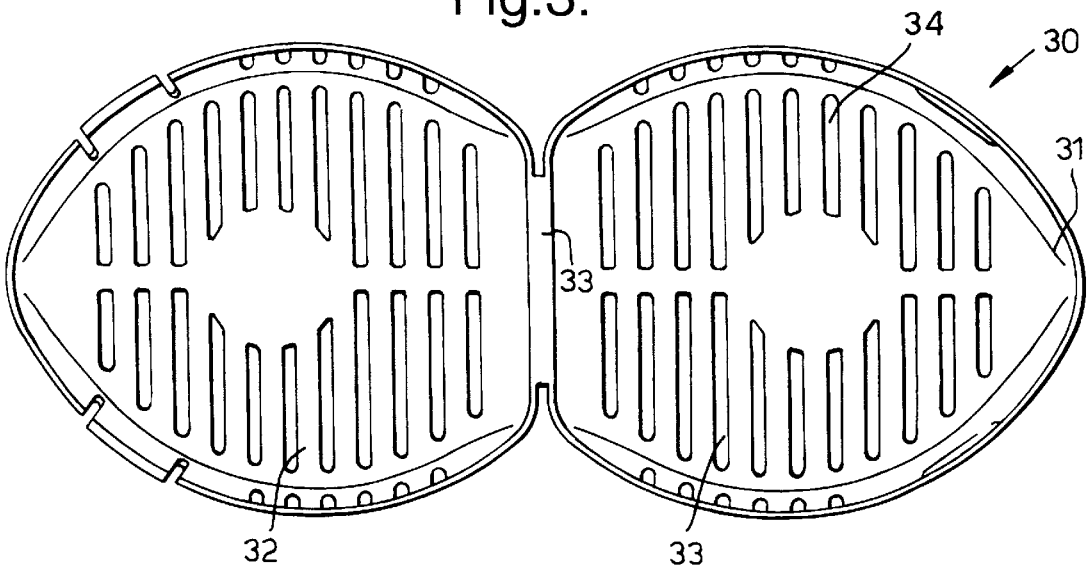
FIGS. 3, 4 and 5 are top plan, side elevational and end elevational views, respectively, of a device according to a further embodiment of the invention.
Figure 4:
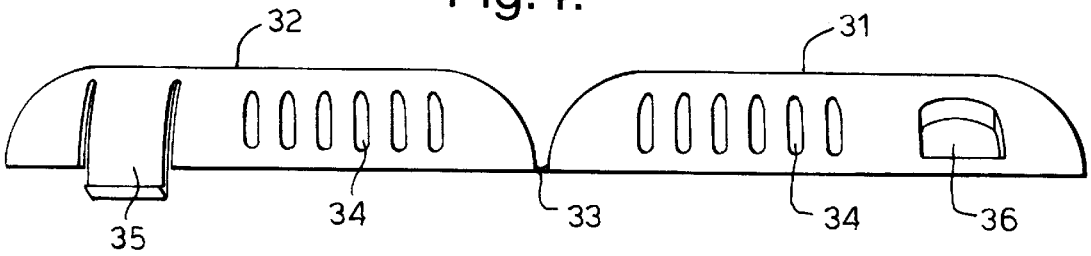
Figure 5:
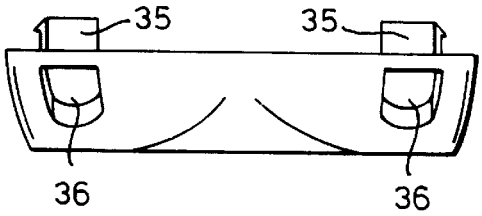

FIGS. 3 to 5 illustrate a device 3 comprising a housing for detergent tablets in two parts 31, 32 hingedly connected along a common edge 33, each part having a plurality of slotted apertures 34, and which parts 31, 32 snap together via tabs 35 on one part which engage corresponding sockets 36 on a opposed part to form a receptacle for a detergent tablet. The use of this embodiment is similar to that described for previous embodiments.

When tablets are dosed in a washing machine without the use of a dosing device there is a substantial risk of lodging; ie tablets end up in porthole, primarily at the start of the wash. This happens in particular in machines where the space between the door and the drum is such that it can accommodate a tablet or pieces of tablets. The residence time of tablets in a porthole depends on water intake level.

As the trend in new machines is to reduce levels of water, even to the extent that the level of water is below the porthole, it is understandable that in such machines tablets do not completely dissolve in the main wash. This will have an effect on performance and level of residues. As an example the Miele W918, AEG lavamat, Hotpoint, Zanussi jet and Bauknecht Allure show severe lodging in 50 to 75% of the washes.

When tablets are dosed via a device, developed such that there is a barrier which prevents the tablets falling out of the device, the problem of lodging is solved. The prerequisite for such a device is that it should have some volume otherwise tablets together with the device experience some lodging. To circumvent the low risk of lodging, but also to make it more easier to find the dosing device after the wash and to favour the water flow through the net, the focus at the moment is to develop a rigid device having some volume.

When dosing tablets in net devices it is observed (table) that there is a clear effect of mesh size of net on level of residue as found after the main wash. Apparently nets with less than 1 mm mesh size retard the tablet dissolution significantly which results in residues in the net and is judged to be unacceptable. Therefore mesh size of nets should be at least larger than 1 mm. There is an optimal mesh size of the net; nets with too small a mesh size retard dissolution to an unacceptable level, whereas nets with too large mesh size allow pieces of tablet to "escape" which will increase incidence of lodging (and maybe also cause dye damage as direct contact between tablet and load is more pronounced, see below).

Results also indicate that devices with volume give less residue.

TABLE 1

30° C. washes in four machines. Two tablets dosed in net. Program stopped after main wash and level of residues is scored by weight

| | net (zipped) 5 mm mesh size | net zipped 1 mm mesh size | net rope + plastic ring 5 mm mesh size | net rope plastic ring 1 mm mesh size |
|---|---|---|---|---|
| Miele W918 | − | . . . | + | . . . |
| Zanussi Jet | − | . . . | + | . . . |
| Whirlpool | + | . . . | + | . . . |
| Siemens | − | . . . | + | . . . |

+Totally dissolved after end of main wash
−Some small residues after end of main wash
. . . Between 2.5 and 9 gram after end of main wash From the table below it is clear that concentrated powders (as are on the market) gives more dye fading than free tablets (table), despite levels of bleach being the same; this is surprising but it can be interpreted by assuming that powders when trapped will have a closer contact with load than tablets. Of course this mimics an extreme situation which is more realistic for a tablet than for a powder, i.e. inherently tablets will dissolve slower than powders.

Surprisingly there is decreasing dye damage upon increasing the mesh size. It was expected that the opposite would occur as one can expect that the larger the mesh size the closer the contact will be between the tablet and the load (see e.g. tablet without net, ie. infinite mesh size, having the most dye fading). Again it seems that there is an optimum in mesh size giving the lowest fading. Apparently another mechanism is operational like a delayed dissolution profile of tablets in a 1 mm mesh size net, resulting in more tablet in sachet at higher temperatures giving more fading.

There are also indications that the quality of the net (soft vs. hard) has an effect on dye fading; harder quality gives less fading than soft quality.

As a side effect it was observed that tablets in a net give less residue on the black sachet cloth than when no net was used.

TABLE 2

Combined 40° C. and 60° C. results. Concentrated powder or tablet (with or without net) placed in a small black sachet and a normal wash is conducted in Zanussi jet machine. After a program, dye fading of the black sachet was measured:

| | Delta E (dye fading) |
|---|---|
| Concentrated Powder | 10.1 |
| Tablet (no net) | 6.0 |
| Tablet (net, zipped) 1 mm mesh size soft quality | 3.9 |
| Tablet (net, zipped) 3 mm mesh size hard quality | 2.5 |
| Tablet (net, zipped) 5 mm mesh size soft quality | 3.6 |
| Tablet (net zipped) 5 mm mesh size hard quality | 2.0 |

To investigate the effect of using dosing devices on residues and dye damage on real load and complete wash cycles and to confirm the above findings the following exercise has been carried out:

A low agitation, low temperature program in a Miele washing machine with a load primarily of dark coloured fabrics is repeated a number of times. Products are dosed in the usual way; i.e. powder in scuttle on top of load and tablets on bottom of drum. After a number of washes incidences of residue and dye damage on the load are visually scored (table). N.B. note that with free tablet lodging wash observed but tablets were returned to the load.

1 mm mesh size net gives more residue than free tablet in line with above. Apparently tablet dissolution is retarded such that in the latter part of the wash part of tablet are still present giving a rise in incidences of residues and dye damage.

Nets with larger mesh sizes (3 mm and 5 mm) reduces the risk of residues and dye damage. It is particularly unexpected, but in line with above results, that the risk of dye damage is reduced.

Also unexpected is the clear better score on dye damage for the tablet in the 5 mm sachet compared to NG Persil Powder (same bleach level).

TABLE 3

Total incidences of residue and dye damage.

| | Residue[1] | Dye Damage |
|---|---|---|
| Free Tablet[2] | 20 | 3 |
| 1 mm net[3] | 31 | 3 |
| 3 mm net | 19 | 2 |
| 5 mm net | 15 | 1 |
| NG Persil Powder | 22 | 4 |

[1]Total residue incidences including patches, particles and filming
[2]Lodging was observed (tablets were returned to the load)
[3]The 1 mm net retained product Detergent Tablet Compositions

EXAMPLE 1

Tablets for use in fabric washing were made, starting with a spray-dried base powder of the following composition:

| | |
|---|---|
| Sodium linear alkylbenzene sulphonate | 11.83% |
| Sodium tripolyphosphate, type 1A[1] | 44.83% |
| Nonionic detergent[2] | 7.88% |
| Sodium silicate | 11.83% |
| Soap | 1.13% |
| Sodium carboxymethyl cellulose | 0.9% |
| Acrylate/maleate copolymer | 3.2% |
| Sodium sulphate and minor ingredients | 3.0% |
| Water | balance to 100% |

[1]This contained less than 30% of the phase I form of anhydrous sodium tripolyphoshate.
[2]$C_{13-15}$ fatty alcohol 7EO.

This powder was mixed with particles of sodium tripolyphosphate specified to contain 70% phase I form and contain 3.5% water hydration (Rhodia-Phos HPA 3.5 available from Rhone-Poulenc) and other detergent ingredients as tabulated below. As a comparative composition the base powder was mixed with urea and other detergent ingredients.

Two compositions thus contained the following percentages by weight.

| | Example 1 | Comparative A |
|---|---|---|
| Base Powder | 63.25 | 63.25 |
| Sodium perborate tetrahydrate | 10.4 | 10.4 |
| TAED granules | 4.0 | 4.0 |
| Anti-foam granule | 2.0 | 2.0 |
| Enzymes | 0.85 | 0.85 |
| Phosphonate | 0.5 | 0.5 |
| Sodium carbonate | 3.6 | 3.6 |
| HPA tripolyphosphate | 15.0 | — |
| Urea | — | 15.0 |

35 g portions of each composition were made into cylindrical tablets of 44 mm diameter, using a Carver hand press.

The strength of these tablets was measured using an Instron universal testing machine to compress a tablet until fracture. The value of diametral fracture stress (DFS) was then calculated using the equation.

$$\frac{\sigma = 2P}{\prod Dt}$$

where σ is the diametral fracture stress in Pascals, P is the applied load in Newtons to cause fracture, D is the tablet diameter in metres and t is the tablet thickness in metres.

The break-up, dispersion and dissolution of tablets was measured by a test procedure in which a tablet is placed on a plastic sieve with 2 mm mesh size which was immersed in 9 litres of demineralised water at ambient temperature of 22° C. and rotated at 200 rpm. The water conductivity was monitored until it reached a constant value.

The time for break up and dispersion of the tables was taken as the time ($T_{90}$) for change in the water conductivity to reach 90% of its final magnitude. This was also confirmed by visual observation of the material remaining on the rotating sieve.

The results were:

| | Example 1 | Comparative A |
|---|---|---|
| Tablet strength (kPa) | 19.5 | 21.9 |
| Tablet dissolution $T_{90}$ (min) | 3.35 | 13.4 |

This shows that tablets of this Example dissolved much faster than the comparative tablets of similar strength made with urea.

EXAMPLE 2

| | |
|---|---|
| Coconut alkyl sulphate[1] | 2.9% |
| Zeolite A24[2] | 52.9% |
| Sodium carbonate | 0.7% |
| Nonionic detergent[3] | 25.9% |
| Soap | 5.9% |
| Sodium carboxymethyl cellulose | 1.4% |
| Fluorescer | 0.4% |
| Acrylate/maleate copolymer | 0.7% |

1. The coconut alkyl sulphate was. incorporated as preformed granules containing 45% coconut alkyl sulphate, 35% zeolite, 11% sodium carbonate, balance water and other salts.

2. Maximum aluminium zeolite P from Crosfields.

3. $C_{13-15}$ fatty alcohol 7E0.

This powder was mixed with sodium acetate trihydrate (from Merck as used in Example 1) and other detergent ingredients as tabulated below. As a comparative composition the base powder was mixed with sodium citrate dihydrate and other detergent ingredients and then sprayed with polyethylene glycol (Molecular Weight 1500) at 80° C.

The two compositions thus contained:

| | A (with Na-acetate 3 aq). parts by weight | B (comparative) parts by weight |
|---|---|---|
| Base powder | 53.02 | 53.02 |
| Na-perborate 4 aq. | 19.99 | 19.99 |
| TAED granules | 4.49 | 4.49 |
| Anti-foam granule | 3.42 | 3.42 |
| Enzymes | 1.5 | 1.5 |
| Phosphonate | 1.0 | 1.0 |
| Perfume | 0.43 | 0.43 |
| Na-acetate 3 aq. | 16.13 | |
| Silicate-carbonate co-granule | | 5.5 |
| Na-citrate 2 aq. | | 8.03 |
| PEG 1500 | | 2.5 |

35 g portions of each composition were made into cylindrical tablets of 44 mm diameter, using a Carver hand press with various levels of compaction force.

The strength of these tablets was measured using an Instron universal testing machine to compress a tablet until fracture. The value of diametral fracture stress (DFS) was then calculated using the equation $$\blacklozenge = \frac{2P}{\pm Dt}$$

where ♦ is the diametral fracture stress in Pascals, P is the applied load in Newtons to cause fracture, D is the tablet diameter in metres and t is the tablet thickness in metres.

The break-up, and dispersion of tablets was measured by the procedure of Example 1, using one tablet on the rotating sieve.

The results are set out in the following table:

| Compaction | A Tablets with Acetate.3H,O | | B Comparative tablets with citrate and PEG | |
|---|---|---|---|---|
| Force (kN) | Strength (DFS in kpa) | $T_{90}$ (minutes) | Strength (DFS in kPa) | $T_{90}$ (minutes) |
| 1 | 5.1 | 4.0 | — | — |
| 2 | 7.2 | 3.8 | 19.3 | 11.1 |
| 4 | 13.7 | 3.9 | 31 | 25 |
| 5 | 20.8 | 7.5 | 43 | 30 |

It can be seen that the tablets containing acetate trihydrate, made with 5 kN compaction force were almost equal in strength to the comparative tablets made at 2 kN force, but dispersed faster and did not require a process step of spraying polymer onto the powder.

In this specification the term "mesh sizes" is understood that size of hole which would allow particles of equivalent size or diameter to pass through. Thus a net having a mesh size of 1 mm will allow all particles of average diameter of 1 mm or less to pass through.

Generally the net bag of the invention will be flexible, however, more rigid or resiliently deformable materials may be used within the scope of the invention.

The process and device of the invention may be varied in many ways without departing from the spirit of the invention.

What is claimed is:

1. A process for washing laundry in a washing machine by employing a receptacle for dispensing one or more detergent tablet, the receptacle being substantially rigid and having a plurality of apertures for permitting the passage of an aqueous solution there through, the process comprising the steps of:

placing the dispensing receptacle having one or more detergent tablet contained therein in a washing machine together with the laundry to be washed; and carrying out a washing operation, the process being characterised in that the apertures have an average dimension equivalent to a mesh size of between 1 and 10 mm.

2. A process as claimed in claim 1 wherein the apertures have an average dimension equivalent to a mesh size of approximately 5 mm.

3. A process as claimed in claim 1 in which the or each detergent tablet comprises a tripolyphosphate composition.

4. A process as claimed in claim 3 wherein the or each detergent tablet comprises a compacted particulate detergent composition containing one or more detergent-active compounds together with sodium tripolyphosphate and other ingredients, and in which the tablet or a region thereof comprises particles in which contain sodium tripolyphosphate with a content of the phase 1 form which is more than 40% by weight of the sodium tripolyphosphate in the particles, wherein the sodium tripolyphosphate in the particles contains water of hydration distributed throughout the tripolyphosphate in an amount between 1% and 5% by weight of the sodium tripolyphosphate in the particles.

5. A process as claimed in claim 1 in which the detergent tablet comprises sodium acetate trihydrate, optionally together with sodium citrate dihydrate.

6. A process as claimed in claim 5 wherein the detergent tablet comprises a compacted particulate composition and in which the tablet or a region thereof comprises from 15% to 93% by weight of a water-softening agent, wherein the tablet or a region thereof contains 2% to 35% by weight of a salt which is sodium acetate trihydrate, potassium acetate or mixture thereof optionally together with sodium citrate dihydrate, such that the total quantity of sodium acetate trihydrate and sodium citrate dihydrate is from 7% to 50% by weight of the tablet or a region thereof.

7. A process as claimed in claim 1 wherein the receptacle is reusable and comprises an opening for reception of the detergent tablet and closure means for preventing the passage of the tablet out of the receptacle through the opening, the process including the initial step of placing one or more a detergent tablets in the dispensing receptacle.

8. A process as claimed in claim 7 in which the closure means comprises a plurality of resiliently flexible members mounted to a periphery of the opening and projecting radially at least partially across the opening.

9. A process as in claim 7 in which the closure means comprises a diaphragm mounted across the opening, which diaphragm includes an aperture for insertion of a tablet.

10. A process as claimed in claim 9 in which the diaphragm comprises a resiliently deformable material.

11. A process as claimed in claim 1 wherein the receptacle is reusable and optionally comprises two parts which when connected together form a housing for at least one detergent tablet.

12. A process as claimed in claim 11 in which the two parts are connected by a hinge.

13. A process as claimed in claim 11 in which the device is injection moulded in one piece.

14. A process as claimed in claim 1 in which the receptacle is produced from a material capable of withstanding temperatures for the machine washing or drying of laundry, especially up to 150° C.

15. A dispensing device for carrying out the process of claim 1 and comprising a receptacle for housing a detergent tablet, the receptacle being substantially rigid and having a plurality of apertures for permitting the passage of an aqueous solution there through, the device being characterised in that the apertures of the receptacle have an average dimension equivalent to a mesh size of between 1 and 10 mm.

16. A dispensing device as claimed in claim 15 in combination with a detergent in a solid, non powder form.

17. A dispensing device as claimed in claim 16 in combination with a detergent tablet.

18.Use of a device as claimed in claim 15 in the machine washing of laundry.

* * * * *